US011877629B1

(12) United States Patent
Chung

(10) Patent No.: US 11,877,629 B1
(45) Date of Patent: Jan. 23, 2024

(54) BOTTOM STOP DEVICE OF DOUBLE-OPEN END ZIPPER AND ASSEMBLY STRUCTURE THEREOF

(71) Applicant: KCC ZIPPER CO., LTD., Tong Xiang (CN)

(72) Inventor: Chun-Yen Chung, New Taipei (TW)

(73) Assignee: KCC ZIPPER CO., LTD., Tong Xiang (CN)

( * ) Notice: Subject to any disclaimer, the term of this patent is extended or adjusted under 35 U.S.C. 154(b) by 0 days.

(21) Appl. No.: 18/119,794

(22) Filed: Mar. 9, 2023

(30) Foreign Application Priority Data

Feb. 4, 2023 (TW) ..... 112104014
Feb. 4, 2023 (TW) ..... 112201018

(51) Int. Cl.
*A44B 19/38* (2006.01)

(52) U.S. Cl.
CPC ..... *A44B 19/388* (2013.01); *A44B 19/382* (2013.01)

(58) Field of Classification Search
CPC ..... A44B 19/382; A44B 19/388
See application file for complete search history.

(56) References Cited

U.S. PATENT DOCUMENTS 2,553,230 A * 5/1951 Bashover ..... A44B 19/382 24/436
4,078,279 A * 3/1978 Heimberger ..... A44B 19/38 24/434
6,088,888 A * 7/2000 Oda ..... A44B 19/38 24/433
7,320,158 B2 * 1/2008 Deto ..... A41F 1/002 24/433
8,484,764 B2 * 7/2013 Damon ..... A41F 1/00 2/96
8,813,319 B2 * 8/2014 Ogura ..... A44B 19/382 24/434
8,910,352 B2 * 12/2014 Nozaki ..... A44B 19/26 24/433
10,292,461 B2 * 5/2019 Jin ..... A44B 19/24
2003/0115725 A1 * 6/2003 Matsumoto ..... A44B 19/388 24/433
2008/0040901 A1 * 2/2008 Himi ..... A44B 19/38 24/433
2008/0222855 A1 * 9/2008 Takani ..... A44B 19/388 24/433
2009/0094805 A1 * 4/2009 Keyaki ..... A44B 19/388 24/433
2012/0124788 A1 * 5/2012 Keyaki ..... A44B 19/388 24/386

(Continued)

*Primary Examiner* — Jason W San
(74) *Attorney, Agent, or Firm* — Che-Yang Chen; Law office of Michael Chen

(57) ABSTRACT

The present invention discloses a bottom stop device of double-open end zipper and assembly structure thereof. The bottom stop device can be used in double-open end anti-pinch zippers and double-open end invisible zippers. It includes a stopper pin unit and a movable pin unit for injection molding at the lower end of the two chain straps, so that the two zipper sliders can slide to the stopper pin unit. The movable pin of the movable pin can be inserted into the two zipper sliders to fit with the stopper pin unit, and the movable pin can also be withdrawn from the two zipper sliders in reverse to separate the two chain straps from each other.

15 Claims, 15 Drawing Sheets

(56) References Cited

U.S. PATENT DOCUMENTS

| | | | | |
|---|---|---|---|---|
| 2012/0167354 | A1* | 7/2012 | Keyaki | A44B 19/388<br>24/386 |
| 2012/0260468 | A1* | 10/2012 | Nozaki | A44B 19/28<br>24/386 |
| 2013/0042442 | A1* | 2/2013 | Takani | A44B 19/38<br>24/432 |
| 2014/0020217 | A1* | 1/2014 | Kojima | A44B 19/36<br>24/436 |
| 2021/0282510 | A1* | 9/2021 | McHugh | A44B 19/382 |

* cited by examiner

BOTTOM STOP DEVICE OF DOUBLE-OPEN END ZIPPER AND ASSEMBLY STRUCTURE THEREOF

BACKGROUND OF THE INVENTION

(a) Field of the Invention

The present invention relates to zipper technology, and more particularly, to a bottom stop device of double-open end zipper and assembly structure thereof, which can be applied to the lower end of a double-open end anti-pinch zipper or double-open end invisible zipper, so that the two chain straps of the double-open end zipper can be linked together or completely separated, especially suitable for application on coats.

(b) Description of the Prior Art

To this end, the prior art has proposed a variety of anti-pinch zipper design solutions, such as those shown in WO2014033926A1, U.S. Pat. No. 6,701,584B2, EP3289908A1, CN107567291A, CN106333432A, CN104106888A, CN211298642U and other patent cases, but the above technologies are not ideal. The applicant in this case has proposed an anti-pinch zipper (application number Ser. No. 17/552,671).

Nowadays, zippers are commonly used in clothing, but as long as there is an inner clothing, when the zipper slider moves, it may be caught in the inner fabric, causing the zipper slider to move unsmoothly. If it is seriously involved in the inner fabric, it will cause the entire zipper slider to be stuck, making it impossible to advance or retreat at all. There are many kinds of anti-pinch zippers in the known technology, such as WO2014033926A1, U.S. Pat. No. 6,701,584B2, EP3289908A1, CN107567291A, CN106333432A, CN104106888A, CN211298642U, but the above known technologies are not ideal. The applicant of this case proposed another anti-pinch zipper design, the main feature of which is that the inner side of the chain cloth is folded back into a chain tooth belt, and then the series of teeth is combined with the front of the chain tooth belt, and then a special structure zipper slider is used to drive the two chains to be linked or separated. When the zipper slider slides, the two wings on the back will move in the sliding space under the chain tooth belts, using the blocking effect of the chain fabrics, so the two wings will not touch the inner lining of the clothing, which can achieve the anti-pinch function.

However, the above-mentioned anti-pinch zipper structure proposed by the applicant in this case has the structural feature of the inner side of the chain fabric being reflexed, which is completely different from the characteristic of no reflexing of the inner side of the chain fabric of the general double-opening zipper. Therefore, it causes the bottom stop device of the known open-end zipper to be unsuitable for use in double-open end anti-pinch zippers. In addition, in the known double-open end invisible zipper structure, there is also a structural design in which the inner side of the chain fabric is folded back into a chain tooth belt, and then the series of teeth is combined on the chain tooth belt (such as shown in U.S. Pat. No. 5,586,370A). For this reason, how to propose a bottom stop device suitable for double-open end anti-pinch zippers and double-open end invisible zippers is the subject to be actively overcome by the present invention.

SUMMARY OF THE INVENTION

The present invention has been accomplished under the circumstances in view. It is the main object of the present invention to provide a bottom stop device and assembly structure of double-open end zipper, so that it can be applied to the lower end of the chain strap of double-open end anti-pinch zippers, double-open end invisible zippers or other double-open end zippers to fix the chain tooth belt on the inner side of the chain fabric, which can prevent the zipper slider from falling away from the zipper and enable the two chain straps to be linked together or completely separated, and to stabilize the folded chain tooth belt shape of the anti-pinch zipper chain fabric and have a better effect of resisting lateral tension.

It is another object of the present invention to provide a bottom stop device and assembly structure of double-open end zipper, which through the structural design of the bottom stop device, enables the zipper slider to slide down to the bottom stop device, and can be engaged with the bottom stop device, and has the functions of easier insertion and use.

It is still another object of the present invention to provide a bottom stop device and assembly structure of double-open end zipper, which enables the bottom stop device to fix the reflexed chain tooth belt shape of the inner sides of the two chain fabrics of the double-open end anti-pinch zipper.

It is still another object of the present invention to provide a bottom stop device and assembly structure of double-open end zipper, which enables the stopper of the stopper pin unit to be used as the bottom dead center of the zipper slider and the part where the finger exerts force.

DETAILED DESCRIPTION OF THE PREFERRED EMBODIMENTS

Figure 1:
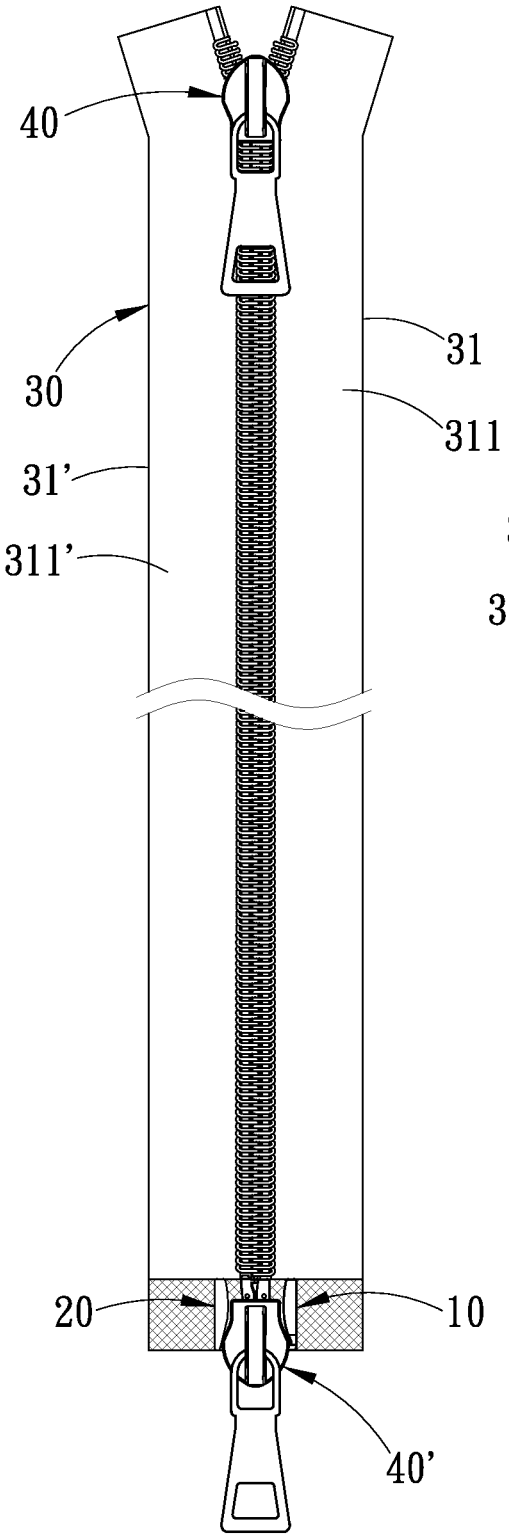
FIG. 1 is a schematic diagram of the front side of the bottom stop device of the present invention applied to the double-open end anti-pinch zipper.
Figure 2:
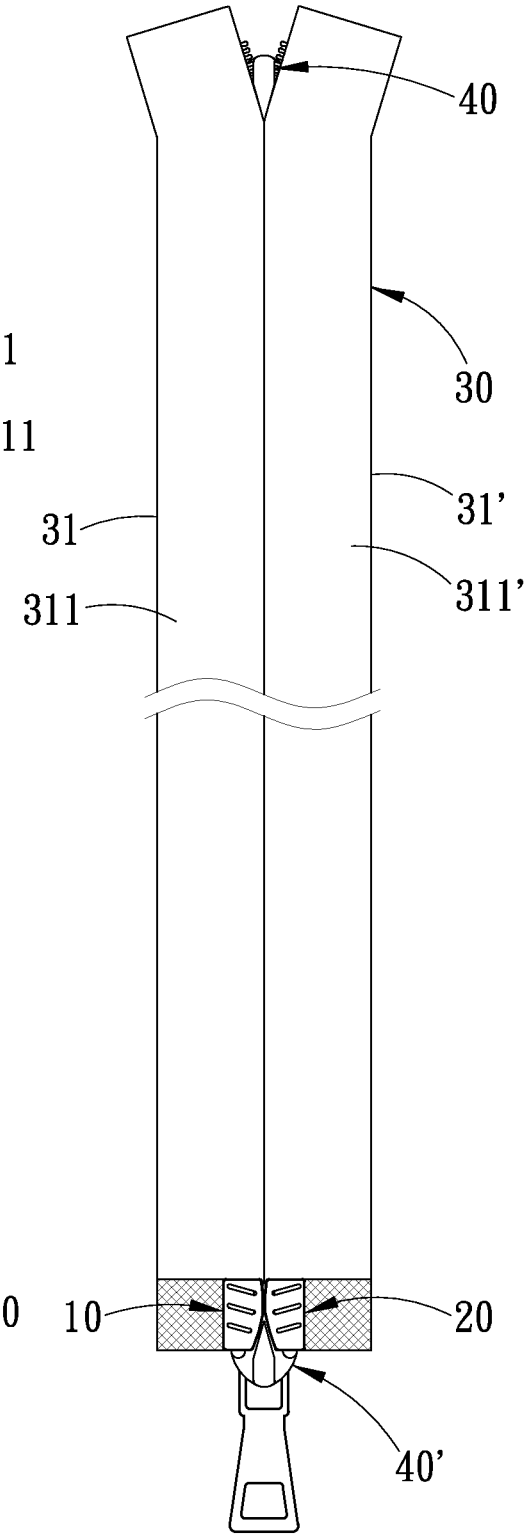
FIG. 2 is a schematic diagram of the back side of the bottom stop device of the present invention applied to the double-open end anti-pinch zipper.
Figure 3:
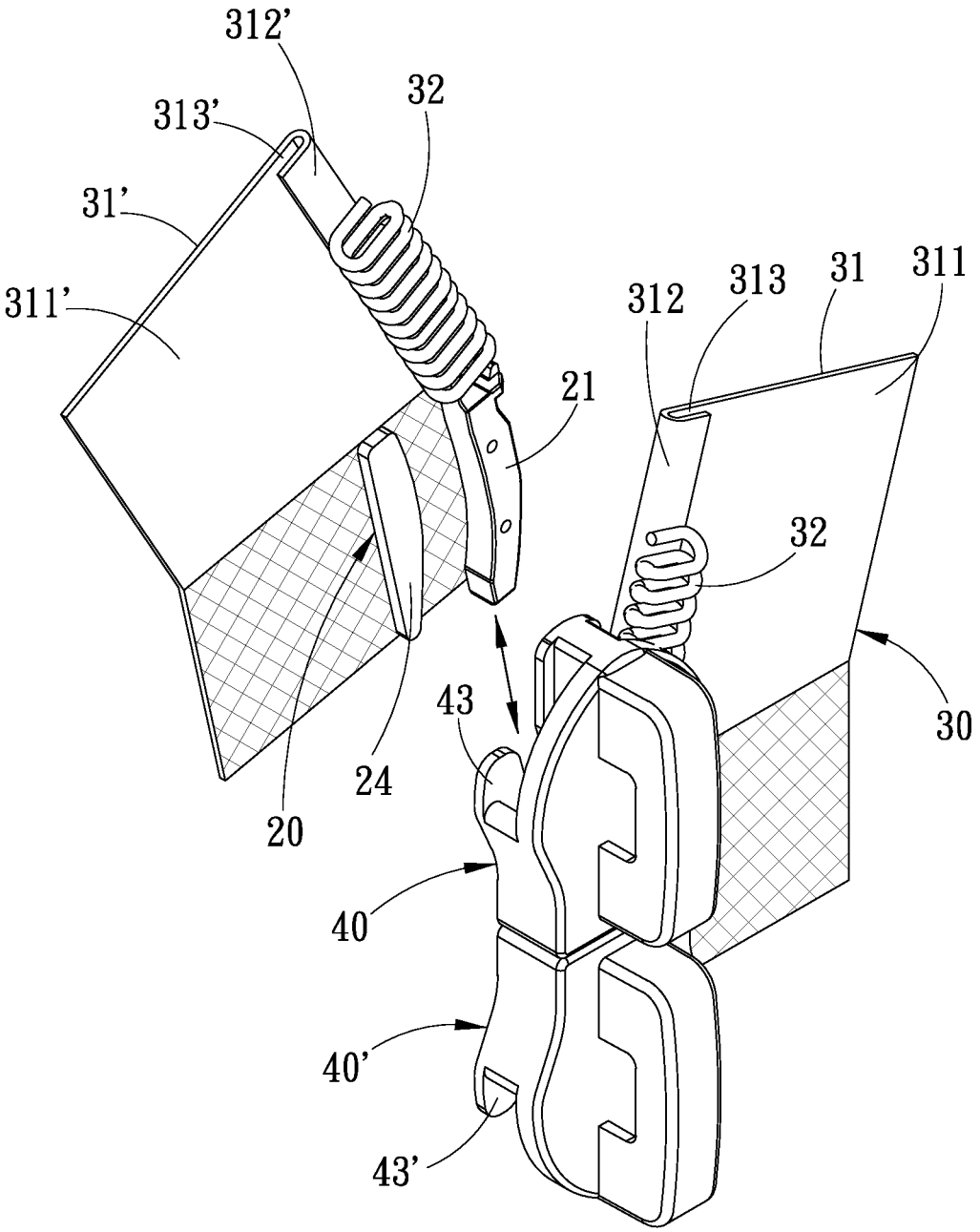
FIG. 3 is a schematic diagram of inserting the movable pin of the present invention into the two zipper sliders of the double-open end anti-pinch zipper or pulling it out in reverse.
Figure 4:
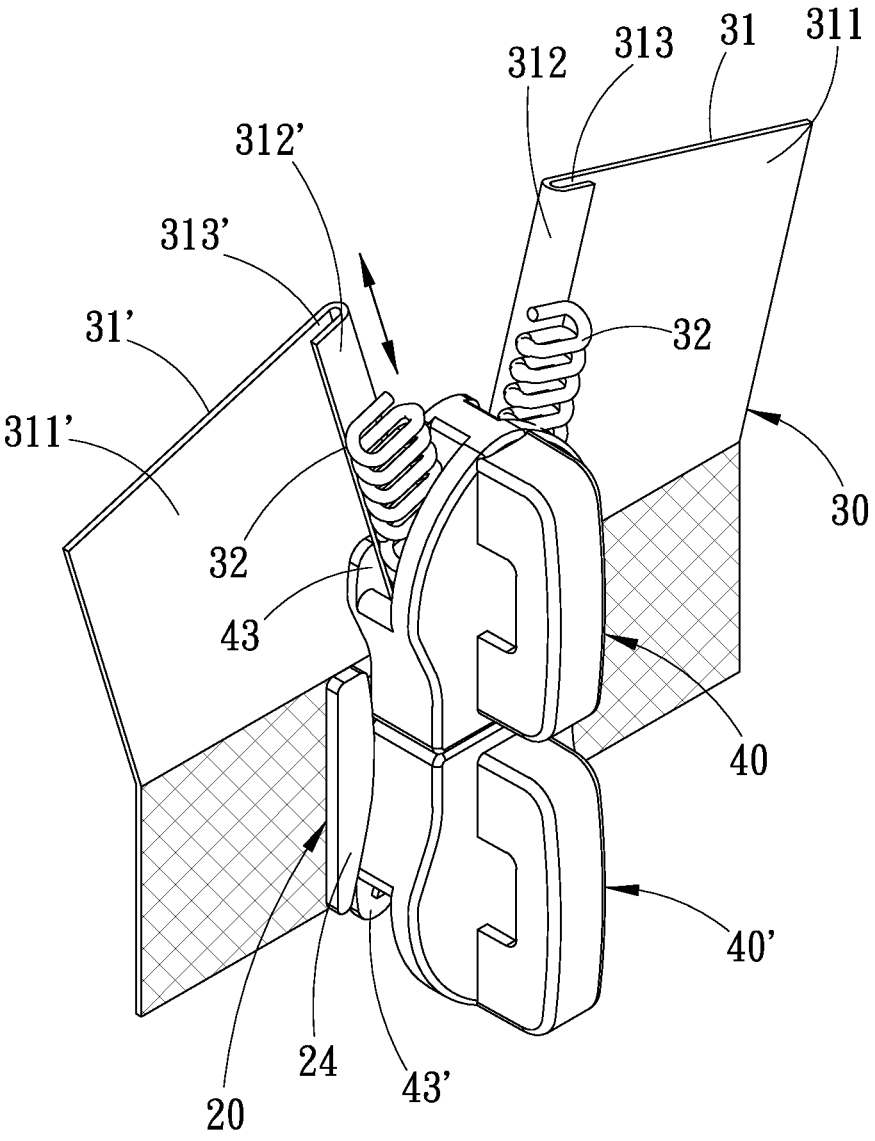
FIG. 4 is a schematic diagram of inserting the movable pin into the double-open end anti-pinch zipper and the two zipper sliders of the present invention.

Referring to FIG. 1 and FIG. 2, the lower stop device of the anti-pinch zipper of the present invention is used to combine the lower ends of the two chain straps 31, 31' of an anti-pinch zipper 30. When the two chain straps 31, 31' are completely pulled apart by a zipper slider 40, the lower ends of the two chain straps 31, 31' can be disassembled and separated; and when the two chain straps 31, 31' are driven and linked by the zipper slider 40, the lower ends of the two chain straps 31, 31' are joined together. Therefore, it is suitable to be used as an open-ended anti-pinch zipper, which is further installed on the front of the jacket, etc. Referring to FIG. 3, FIG. 4 and FIG. 5 again, its preferred embodiment includes a lower stop block 10 and a movable pin unit 20.

Figure 5:
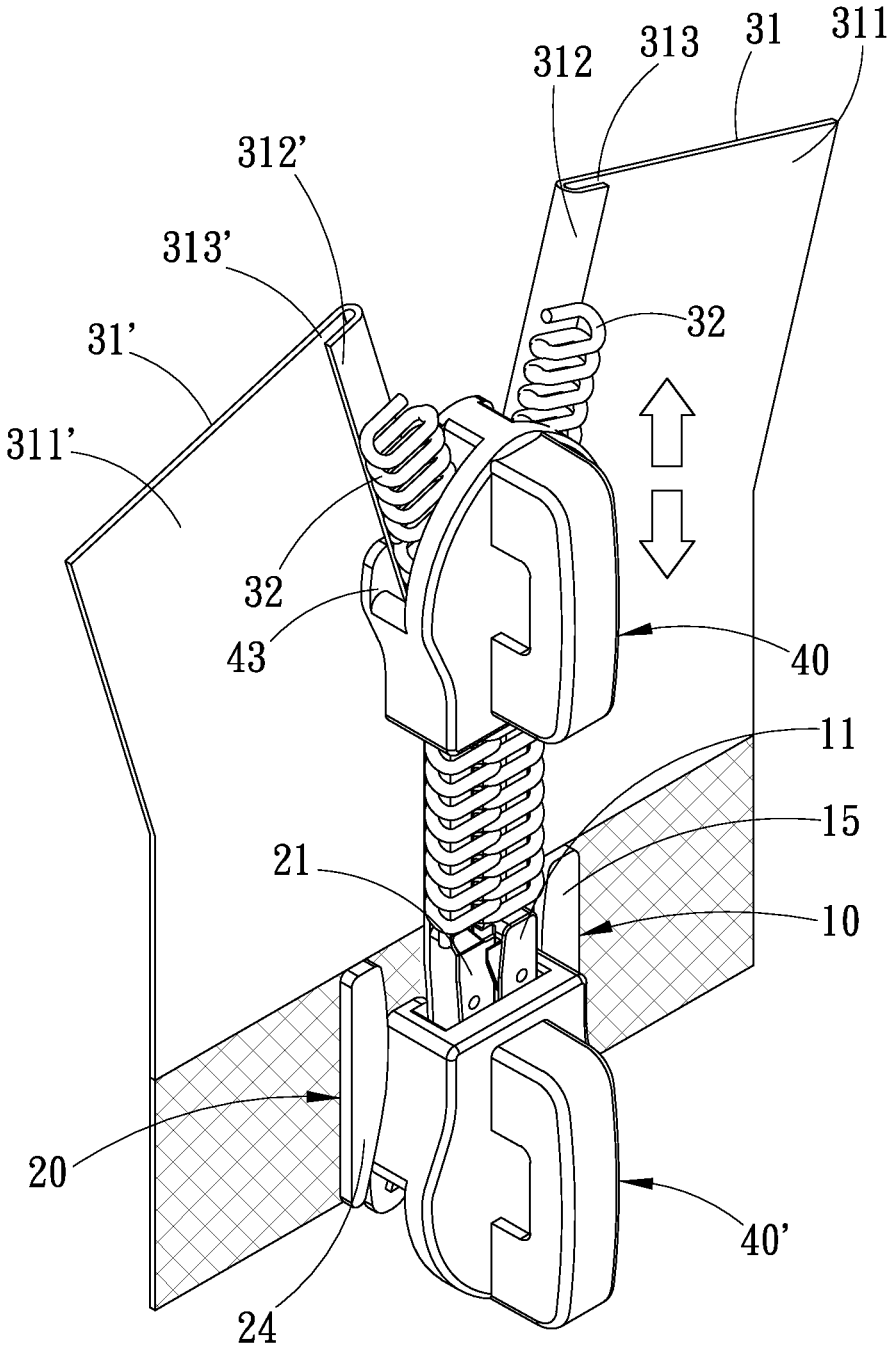
FIG. 5 is a schematic diagram of the zipper slider of the double-open end anti-pinch zipper of the present invention pulling up so that the two chain straps are linked together.
Figure 6:
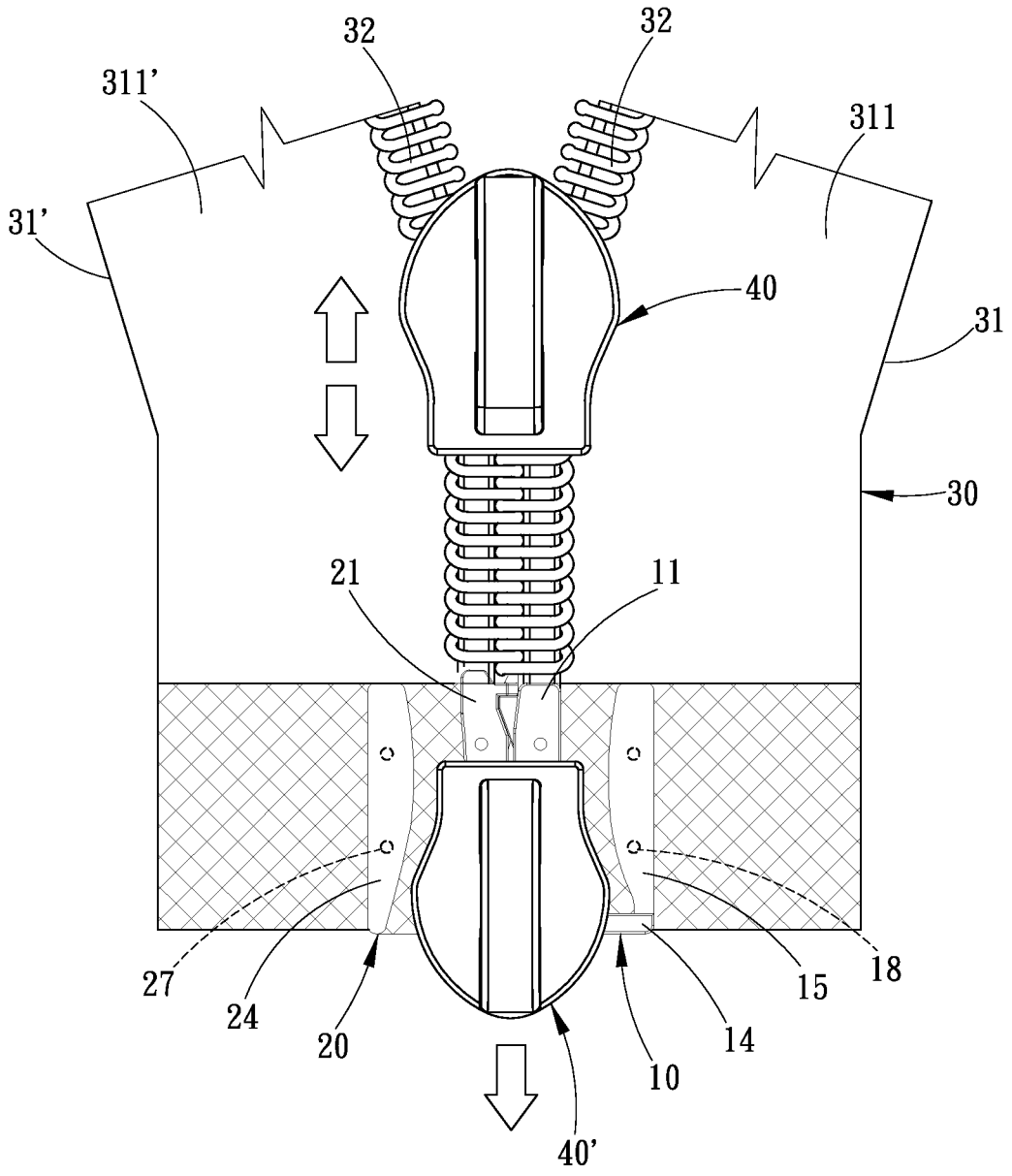
FIG. 6 is an enlarged schematic diagram of the front structure before the bottom stop device of the present invention is applied to the double-open end anti-pinch zipper.
Figure 7:
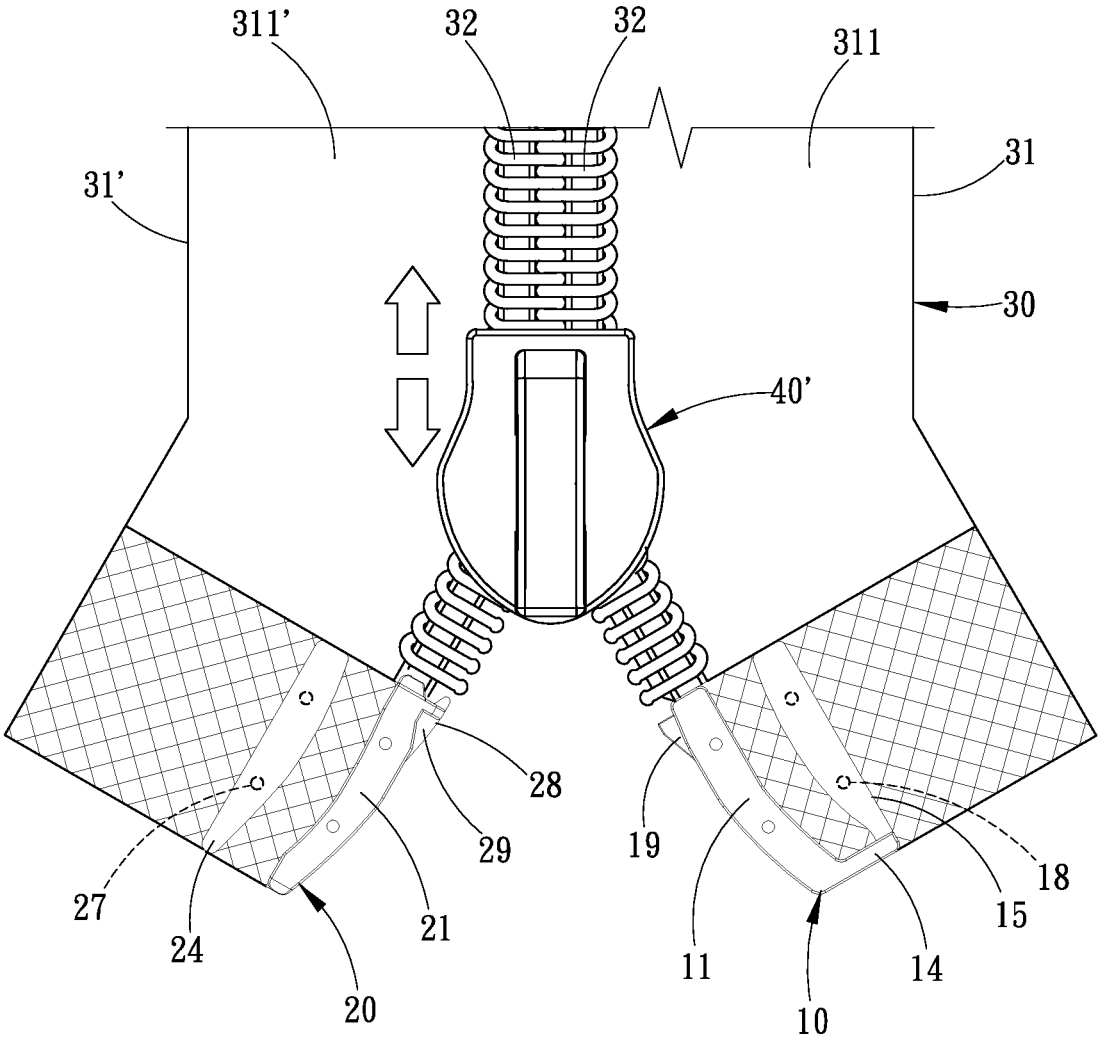
FIG. 7 is a schematic diagram of the double-open end anti-pinch zipper of the present invention pulling up the lower zipper slider to separate the two chain straps.

Referring to FIG. 1 to FIG. 7, the bottom stop device of the double-open end zipper of the present invention, its preferred specific embodiment comprises a stopper pin unit 10 and a movable pin unit 20 to be combined at the lower ends of two chain straps 31, 31' of a double-open end zipper 30. Through the structure of the stopper pin unit 10 and the movable pin unit 20, the upper and lower zipper sliders 40, 40' of the double-open end zipper 30 slide to the bottom stop device of the present invention, then the user can insert the movable pin unit 20 and its chain fabric 311' into the upper and lower zipper sliders 40 and 40' (as shown in FIG. 3 and FIG. 4), so that the stopper pin unit 10 and the movable pin unit 20 are close together, and then pull the upper zipper slider 40 to link the two chain straps 31, 31' together (as shown in FIG. 5 and FIG. 6). Conversely, the movable pin 21 of the movable pin unit 20 can also be extracted from the upper and lower zipper sliders 40, 40' (as shown in FIG. 3 and FIG. 4), so that the two chain straps 31, 31' of the double-open end zipper 30 complete separation. Therefore, the bottom stop device of the present invention can make the double-open end zipper 30 especially suitable for the placket of the coat. Moreover, when the two chain straps 31 and 31' are linked together, the lower zipper slider 40' can also be pulled to separate the stopper pin unit 10 and the movable pin unit 20 to form an open-end state (as shown in FIG. 7).

As shown in FIG. 6 and FIG. 7, the stopper pin unit 10 of the present invention is used for injection molding at the lower end of the first chain fabric 311 of the chain strap 31 of the above two chain straps 31, 31'. Referring to FIG. 8 to FIG. 16, the preferred embodiment of the stopper pin unit 10 comprises a stop pin 11, a first back plate 12, a first chain fabric groove 13, a stopper 14 and a first clamping block 15 integrally formed.

Figure 13:
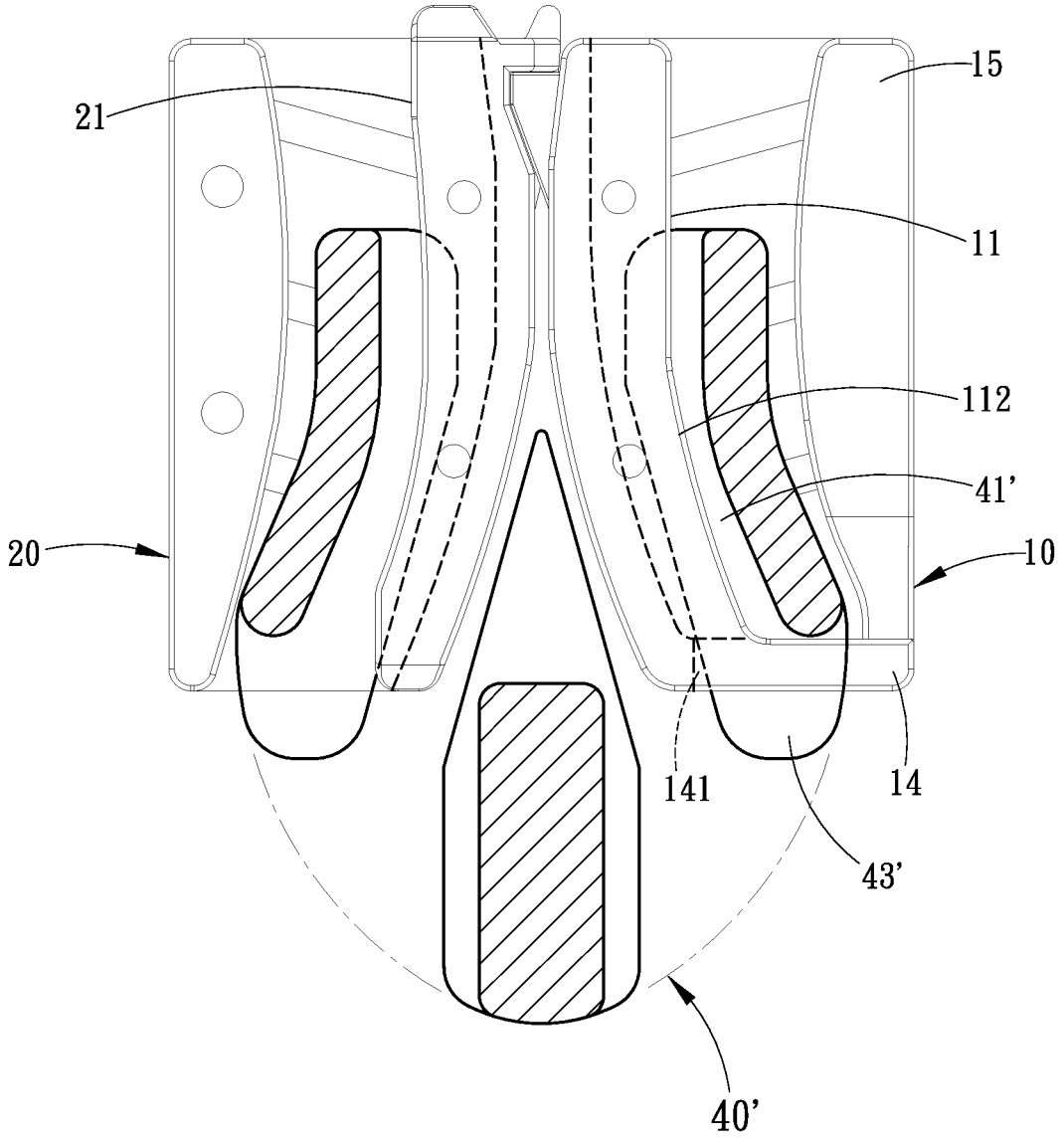
FIG. 13 is a schematic cross-sectional view of the bottom stop device of the present invention blocking the zipper slider.

The stop pin 11 is a first bar-shaped body formed on the inner side of the front of the first back plate 12 with a square section. The first bar-shaped body of the stop pin 11 extends from the top edge of the first back plate 12 to the bottom edge of the first back plate 12 along the inner edge of the first back plate 12. The upper end of the stop pin 11 is used to align with the lower end of the series of teeth 32 inside the first chain fabric 311 (as shown in FIG. 6 and FIG. 7). The stop pin 11 is used when the lower zipper slider 40' slides to the stopper pin unit 10 (as shown in FIG. 6), so that the stop pin 11 is inserted into the guide groove 41' on the first side of the lower zipper slider 40' (as shown in FIG. 13). In particular, the first bar-shaped body of the above stop pin 11 has a first upper section 111 and a first lower section 112. The first upper section 111 is parallel to the inner side of the first chain fabric 311. The first lower section 112 extends obliquely downward towards the outer edge of the first upper section 111 until it is connected to the inner end of the stopper 14.

Figure 15:
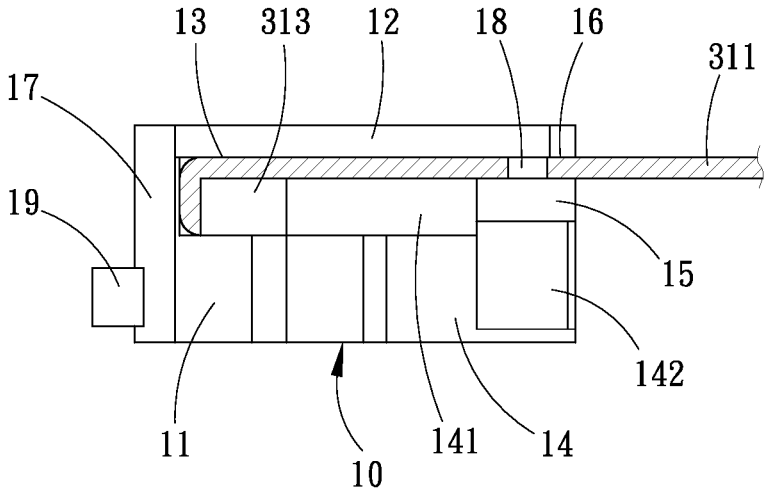
FIG. 15 is a schematic cross-sectional view of a preferred embodiment of the stopper pin unit of the present invention combined with the first chain fabric.

The first back plate 12 of the stopper pin unit 10 is connected to the rear of the stop pin 11, and extends toward the outer side of the stop pin 11 to form a plate body. The first back plate 12 is used to form on the back of the first chain fabric 311 to stabilize the structure near the lower end of the first chain fabric 311. The first chain fabric groove 13 is formed between the stop pin 11 and the first back plate 12, and has a first opening 131 facing the upper end of the stop pin 11 and the outer side of the stop pin 11, so that the first chain fabric groove 13 can be used for accommodating and fixing the reflexed chain tooth belt 312 of the first chain fabric 311 (as shown in FIG. 15). The stopper 14 is formed in front of the bottom edge of the first back plate 12, and protrudes forward from the front of the first back plate 12, so that the stopper 14 is used to block the lower zipper slider 40' (as shown in FIG. 13). The first clamping block 15 is formed on the front outer side of the first back plate 12, extending from the top side of the first back plate 12 along the outer side of the first back plate 12 to the bottom side of the first back plate 12. A first clamping gap 16 is formed between the first clamping block 15 and the first back plate 12, and the first clamping gap 16 is used to accommodate the first chain fabric 311 (as shown in FIG. 15). The first lower section 112 of the stop pin 11 is connected with the inner end of the stopper 14 to form an L-shaped body, so that the stop pin 11 has better structural strength and prevents the stop pin 11 from turning forward and deforming.

Figure 10:
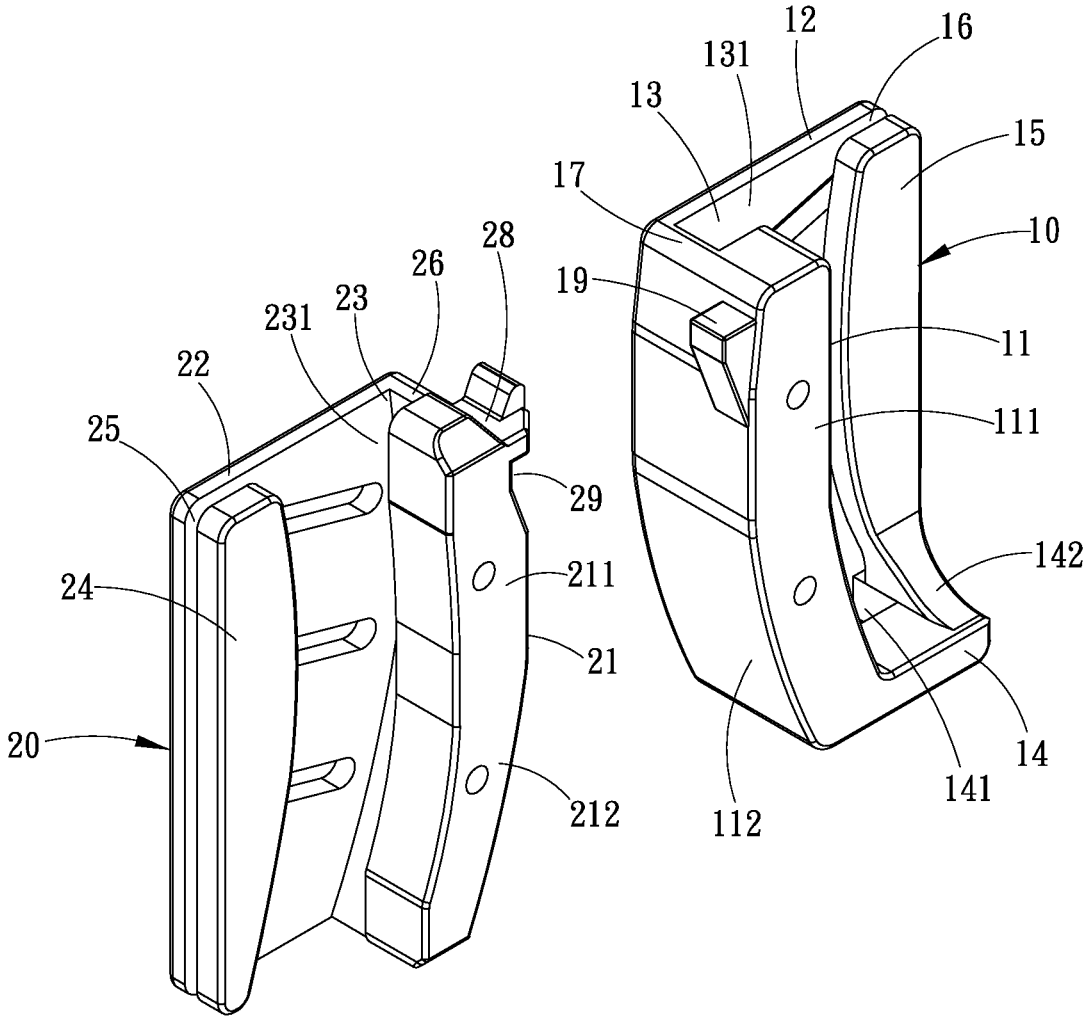
FIG. 10 is a three-dimensional schematic diagram of the first viewing angle of the exploded state of the bottom stop device of the present invention.

Referring to FIG. 10 and FIG. 11 again, the front of the inner side of the first back plate 12 has a first connecting portion 17 integrally connected to the back of the stop pin 11. The first connecting portion 17 is adjacent to the first chain fabric groove 13. Referring to FIG. 6 and FIG. 15 again, the above-mentioned first back plate 12 and the first clamping block 15 are connected together through two first connecting pins 18. The first connecting pins 18 are used to pass through the first chain fabric 311, so that the entire stopper pin unit 10 is injection molded and fixed on the lower end of the first chain fabric 311.

Referring to FIG. 6 and FIG. 7 again, the movable pin unit 20 of the bottom stop device of the present invention is used for injection molding at the lower end of the second chain fabric 311 of the other chain strap 31' of the two chain straps 31, 31'. Also refer to FIG. 8 to FIG. 16, the preferred embodiment of the movable pin unit 20 comprises a movable pin 21, a second back plate 22, a second chain fabric groove 23 and a second clamping block 24 integrally formed.

The movable pin 21 is a second bar-shaped body formed on the inner side of the front of the second back plate 22 with a square section. The second bar-shaped body of the movable pin 21 extends from the top edge of the second back plate 22 along the inner edge of the second back plate 22 to the bottom edge of the second back plate 22 or protrudes from the bottom edge of the second back plate 22. The upper end of the movable pin 21 is used to align with the lower end of the series of teeth 32 on the inner side of the second chain fabric 311' (as shown in FIG. 5). When the upper and lower zipper sliders 40, 40' slide to the stopper pin unit the movable pin 21 is inserted into the upper and lower zipper sliders 40, 40' to be close together with the above stop pin 11 or reversely pulled away from the upper and lower zipper sliders 40, (as shown in FIG. 3 and FIG. 4). The second bar-shaped body of the movable pin 21 preferably has a second upper section 211 and a second lower section 212. The second upper section 211 is parallel to the inner edge of the second chain fabric 311'. The outer edge of the second lower section 212 facing the second upper section 211 extends obliquely downward to the bottom edge of the second back plate 22 or protrudes from the bottom edge of the second back plate 22.

Figure 16:
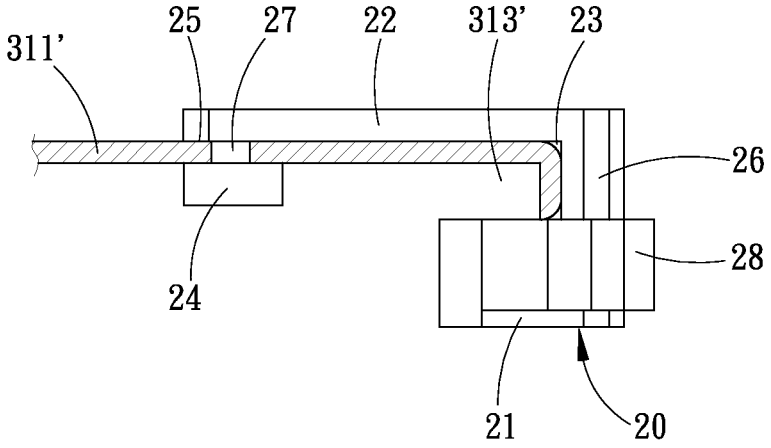
FIG. 16 is a schematic cross-sectional view of a preferred embodiment of the movable pin unit of the present invention combined with the second chain fabric.

The second back plate 22 is connected to the rear of the movable pin 21, and extends to the outer side of the movable pin 21 to form a plate body, so that the second back plate 22 is molded on the back of the second chain fabric 311' to stabilize the structure near the lower end of the second chain fabric 311'. The second chain fabric groove 23 is formed between the movable pin 21 and the second back plate 22, and has a second opening 231 facing the upper end of the movable pin 21 and the outer side of the movable pin 21, so that the second chain fabric groove 23 is used to accommodate the reflexed chain tooth belt 312' of the second chain fabric 311' (as shown in FIG. 10 and FIG. 16). The second clamping block 24 is formed on the front outer edge of the second back plate 22, extending from the top edge of the second back plate 22 along the outer edge of the second back plate 22 to the bottom edge of the second back plate 22. A second clamping gap 25 is formed between the second clamping block 24 and the second back plate 22, and the second clamping gap 25 is used to accommodate the second chain fabric 311' (as shown in FIG. 16).

Referring to FIG. 10 and FIG. 11 again, the front of the inner side of the second back plate 22 has a second connecting portion 26 connected behind the movable pin 21. The second connecting portion 26 is adjacent to the second chain fabric groove 23. The above-mentioned second back plate 22 and the second clamping block 24 are connected together through two second connecting pins 27 (as shown in FIG. 7 and FIG. 16). The connecting pins 27 are used to pass through the second chain fabric 311', so that the entire movable pin unit 20 is injection molded and fixed on the lower end of the second chain fabric 311'.

Figure 8:
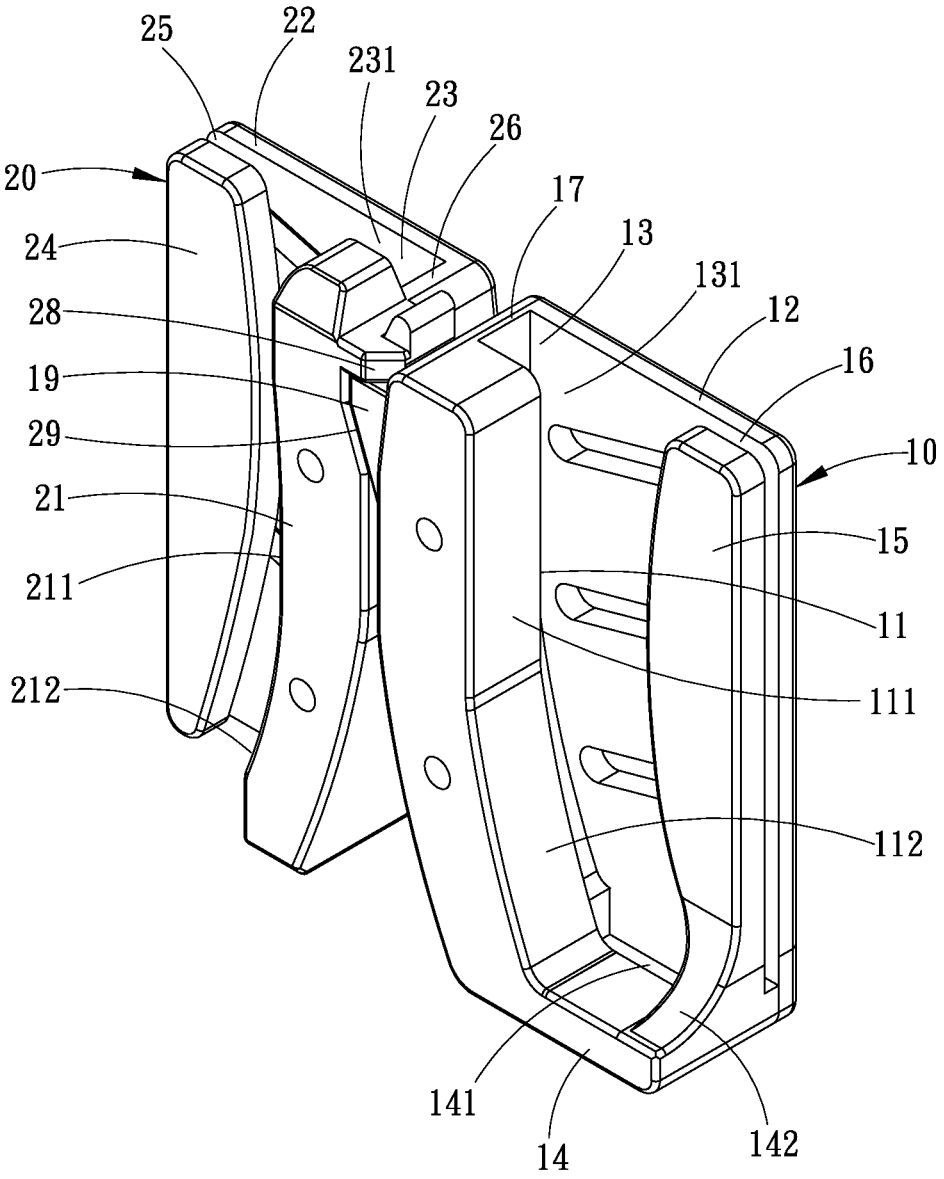
FIG. 8 is a front perspective schematic diagram of the bottom stop device of the present invention.
Figure 9:
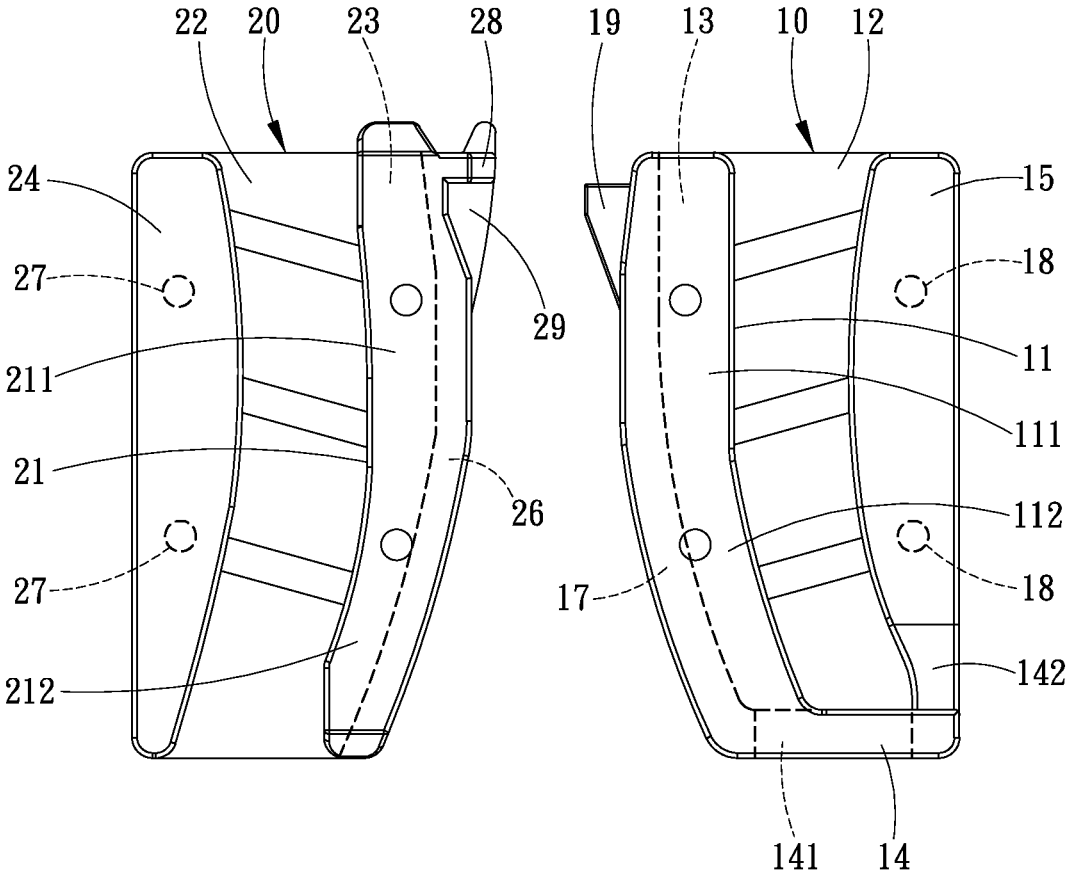
FIG. 9 is a schematic diagram of the front view of the bottom stop device of the present invention.
Figure 11:
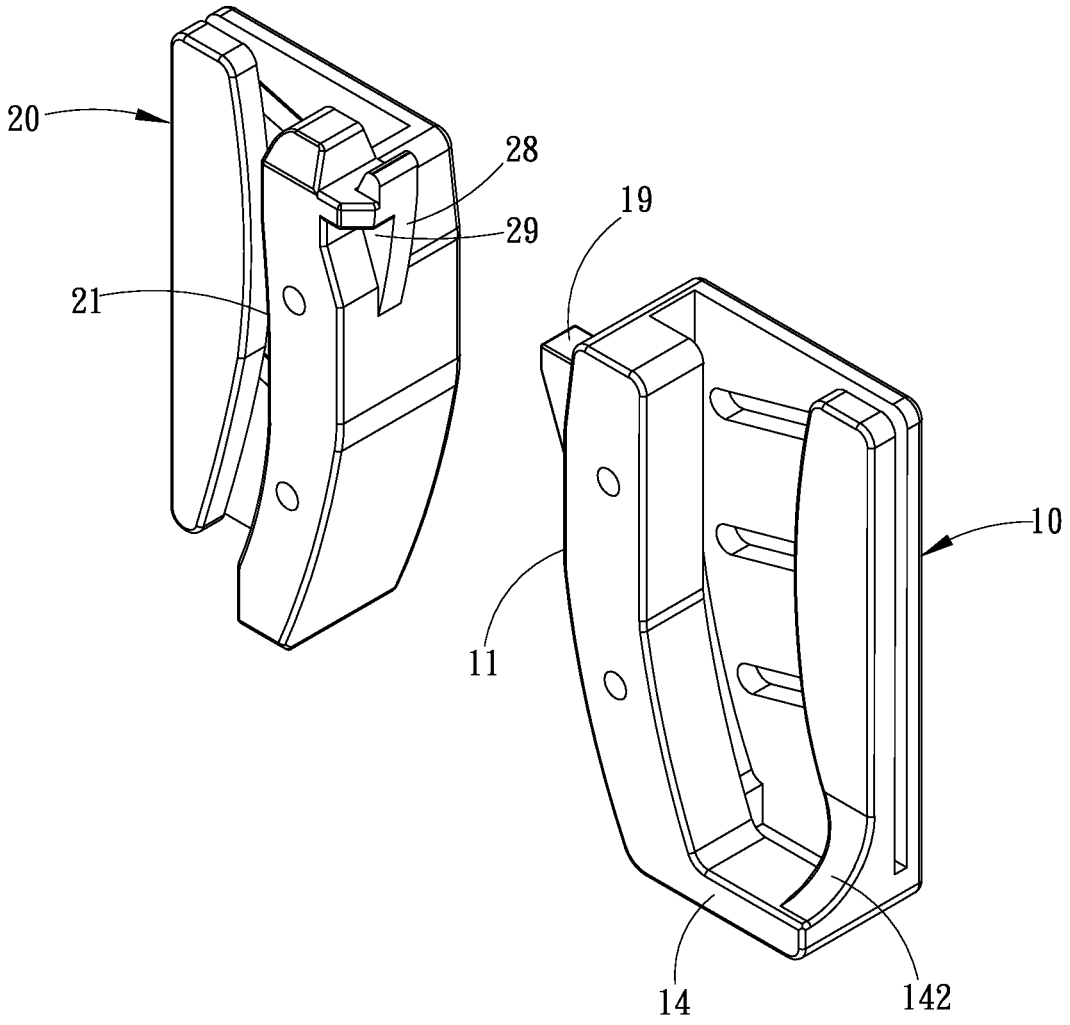
FIG. 11 is a three-dimensional schematic diagram of the second viewing angle of the exploded state of the bottom stop device of the present invention.
Figure 12:
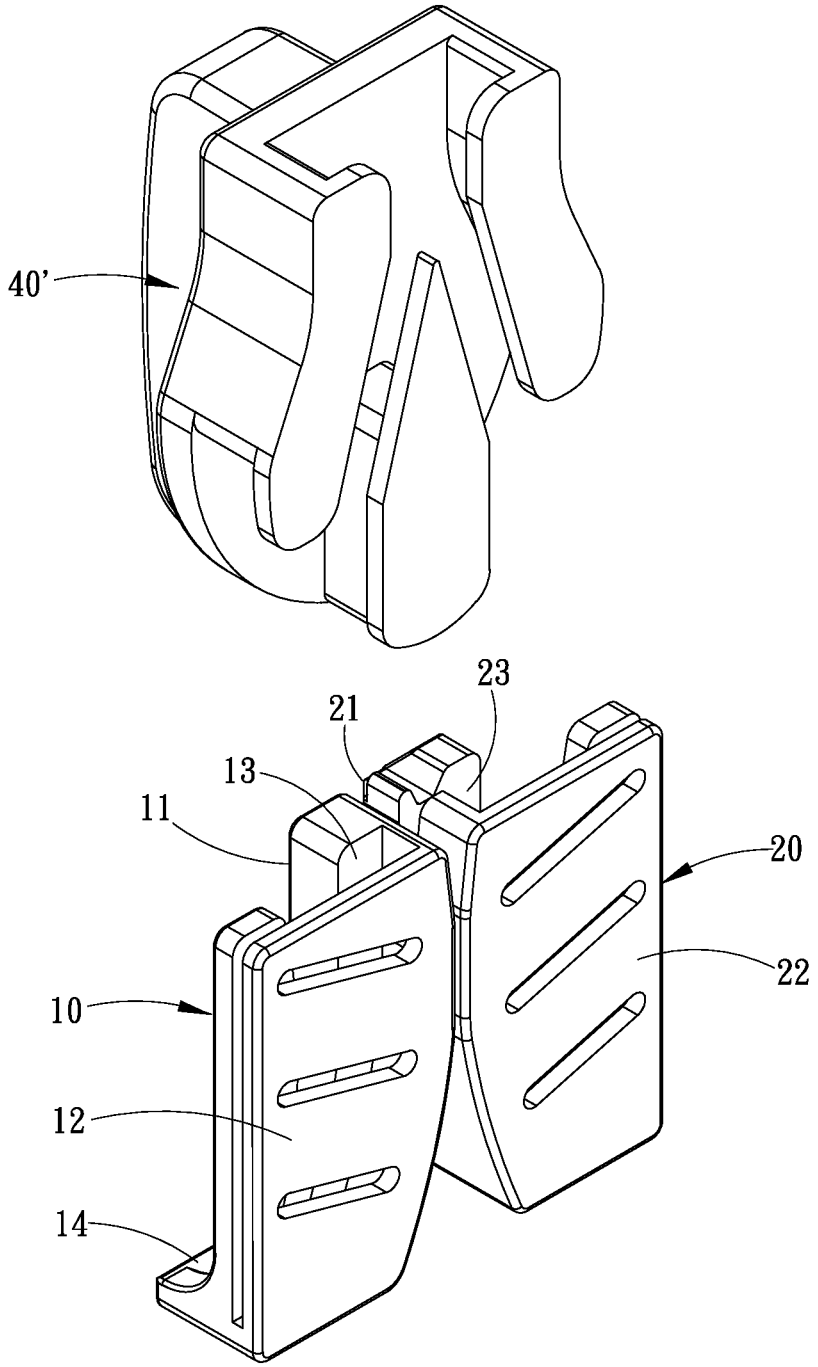
FIG. 12 is a perspective view of the back of the bottom stop device and zipper slider of the present invention.

Referring to FIG. 9 to FIG. 11, the inner side of the stop pin 11 of the stopper pin unit 10 above protrudes a first latch projection 19, and the first latch projection 19 is a triangular projection. A second latch projection 28 protrudes from the inner side of the movable pin 21 of the movable pin unit 20, and the second latch projection 28 has a snap groove 29 matching the first latch projection 19. The snap groove 29 is a groove recessed from the front toward the back of the movable pin 21. When the movable pin 21 of the movable pin unit 20 is inserted into the upper and lower zipper sliders 40 and 40', the first latch projection 19 is locked to the snap groove 29, and then the movable pin unit 20 and the stopper pin unit 10 are merged and aligned together (as shown in FIG. 8 and FIG. 13).

Figure 14:
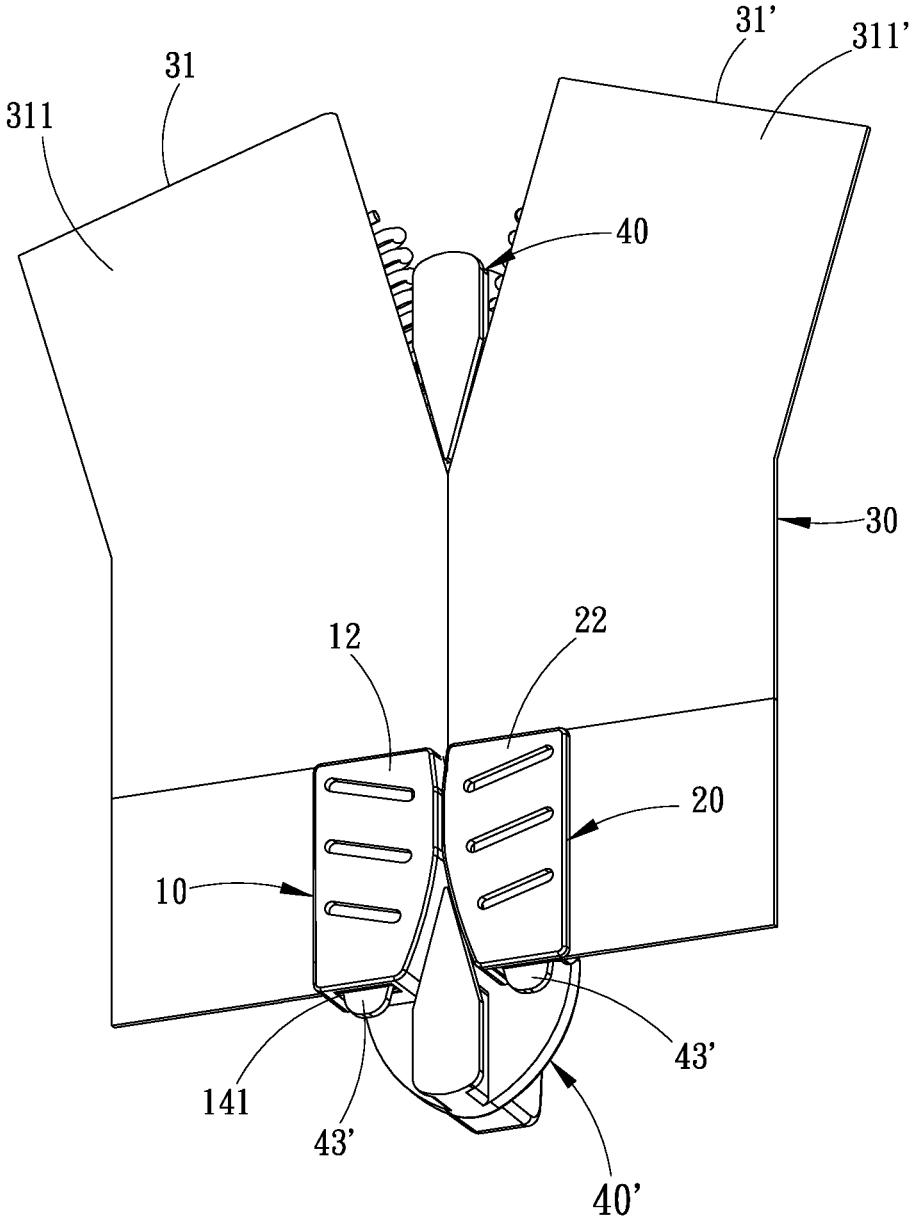
FIG. 14 is a perspective view of the back side of the double-open end anti-pinch zipper, showing the zipper slider blocked by the bottom stop device of the present invention.

Referring to FIG. 13 and FIG. 14, in the present invention, subject to the structure that the first lower section 112 of the stop pin 11 extends obliquely downward toward the outer side of the first upper section 111 until it is connected to the inner side of the stopper 14, and the second lower section 212 of the movable pin 21 extends obliquely downward toward the outer edge of the second upper section 211 until the bottom edge of the second back plate 22 or protrudes from the bottom edge of the second back plate 22, when the lower zipper slider 40' slides to the bottom stop device of the present invention, the first lower section 112 and the second lower section 212 arranged in an inverted V shape in the figure can be stuck on the lower zipper slider 40', and the stopper 14 of the stopper pin unit 10 can block the first side of the lower zipper slider 40'. This can prevent the lower zipper slider 40' from coming out of the bottom stop device of the present invention. Furthermore, the stopper 14 is provided with a through hole 141, the through hole 141 communicates between the top surface and the bottom surface of the stopper 14, and can allow the parts of the first side of the lower zipper slider 40' to pass through the through hole 141.

Referring to FIG. 8, the stopper 14 of the stopper pin unit 10 of the present invention protrudes in front of the bottom edge of the first back plate 12, and can stop the lower zipper slider 40' as the end point of sliding. At the same time, the inner end of the stopper 14 is connected to the stop pin 11, and the outer end of the stopper 14 is connected to the lower end of the first clamping block 15, thereby forming a stable structure and preventing the stop pin 11 from turning forward and deforming. Furthermore, there is a concave arc surface 142 between the first clamping block 15 and the stopper 14. When the user holds the movable pin 21 of the movable pin unit 20 and inserts it into the upper and lower zipper sliders 40, 40' or pulls it out in the opposite direction, the stopper 14 can also be used as an application point for holding the stopper pin unit 10 with the other hand.

Referring again to FIG. 1 to FIG. 7 and FIG. 14, the present invention further proposes a double-open end zipper bottom stop device assembly structure through the above-mentioned bottom stop device structure technology, which can be applied as a double-open end anti-pinch zipper (double-open end anti-pinch zipper with two zipper sliders as shown). Its preferred embodiment comprises a double-open end zipper 30, the stopper pin unit 10 mentioned above, and the movable pin unit 20 mentioned above.

The double-open end zipper 30 is as shown in the patent No. M624460 previously proposed by the present invention, it comprises two chain straps 31, 31' for linking or separating, and upper and lower zipper sliders 40, 40' for driving the two chain straps 31, 31' to link or separate each other. The two chain straps 31, 31' respectively comprise a first chain fabric 311 and a second chain fabric 311', and two series of teeth 32 combined in the first chain fabric 311 and the second chain fabric 311'. The inner edges of the first chain fabric 311 and the second chain fabric 311' are respectively folded toward the front to form a chain tooth belt 312, 312' respectively A sliding space 313, 313' is formed between the first chain fabric 311 and the second chain fabric 311' and its chain tooth belt 312, 312' respectively. The opening side of the sliding space 313, 313' faces the outer edge of its chain fabric. The two series of teeth 32 are respectively combined on the chain tooth belt 312, 312', so that the series of teeth 32 are respectively located on the front of the first chain fabric 311 and the second chain fabric 311' (the front, as shown in FIG. 1). The opposite sides of the first chain fabric 311 and the second chain fabric 311' respectively cover the series of teeth 32 (as shown in FIG. 2). When the two zipper sliders 40 slide, the guide plates 43, 43' on both sides of each zipper slider 40, 40' move in the sliding space 313, 313', so the guide plates 43, 43' will not appear in the back of the op double-open end zipper 30 (as shown in FIG. 2) enables the double-open end zipper 30 to achieve the function of preventing the inner lining of the clothes from being caught.

The above-mentioned stopper pin unit 10 is integrally injection-molded at the lower end of the first chain fabric 311, so that the near lower end and folded inner edge of the first chain fabric 311 are extended and fixed in the first chain fabric groove 13 (as shown in FIG. 15 Show). The lower end of the sliding space 313 of the first chain fabric 311 is connected to the upper end of the first chain fabric groove 13, so that the stop pin 11 is connected in front of the chain tooth belt 312 of the first chain fabric 311. Referring to FIG. 15, the back of the first chain fabric 311 near the lower end is attached to the front of the first back plate 12, and extends laterally through the first clamping gap 16, so that the first chain fabric 311 protrudes from the outer side of the first back plate 12. Therefore, the front of the first back plate 12 is closely connected to the back of the first chain fabric 311 to maintain the configuration of the first chain fabric 311. The above-mentioned stopper 14 protrudes forward from the front of the first back plate 12 to the lower end of the front of the first chain fabric 311 and can be used to block the two zipper sliders 40. The above-mentioned first clamping block 15 is injection-molded on the front of the first chain fabric 311 (as shown in FIG. 1 and FIG. 6), so as to clamp the first chain fabric 311 with the first back plate 12 to produce a better clamping and fixing structure against lateral tension.

The above-mentioned movable pin unit 20 is integrally injection molded at the lower end of the second chain fabric 311', so that the near lower end and the folded inner edge of the second chain fabric 311' are extended and fixed in the second chain fabric groove 23 (such as FIG. 16). Therefore, the lower end of the sliding space 313' of the second chain fabric 311' can be connected to the upper end of the second chain fabric groove 23, so that the movable pin 21 can be jointed in front of the chain tooth belt 312' of the second chain fabric 311' by injection molding. Referring to FIG. 16 again, the back side near the lower end of the second chain fabric 311' is attached to the front of the second back plate 22, and extends laterally through the second clamping gap 25, so that the second chain fabric 311' protrudes from the outer side of the second back plate 22. Therefore, the front of the second back plate 22 is closely connected to the back of the second chain fabric 311' to maintain the configuration of the second chain fabric 311'. The above-mentioned second clamping block 24 is injection-molded and attached to the front of the second chain fabric 311', so as to clamp the second chain fabric 311' with the second back plate 22. In this way, a better clamping and fixing structure against lateral tension is produced.

Referring to FIG. 6, FIG. 15 and FIG. 16, when the above-mentioned stopper pin unit 10 and the movable pin unit 20 are respectively injection-molded on the first chain fabric 311 and the second chain fabric 311', the above-mentioned first connecting pin 18 between the first back plate 12 and the first clamping block 15 passes through the first chain fabric 311, and the above-mentioned second connecting pin 27 between the second back plate 22 and the second clamping block 24 passes through the second chain fabric 311'. In this way, the stopper pin unit 10 and the movable pin unit 20 are more firmly combined with the first chain fabric 311 and the second chain fabric 311', and have better resistance to lateral tension. Moreover, the stopper pin unit 10 and the movable pin unit 20 of the present invention are formed on the first chain fabric 311 and the second chain fabric 311', and the first back plate 12 and the second back plate 22 can be used as parts for the user to grasp, so that the user can easily insert the movable pin unit 20 into the upper and lower zipper sliders 40, 40', so that the movable pin unit 20 and the stopper pin unit 10 are merged together. Conversely, the movable pin unit 20 can be easily pulled out.

Figure 17:
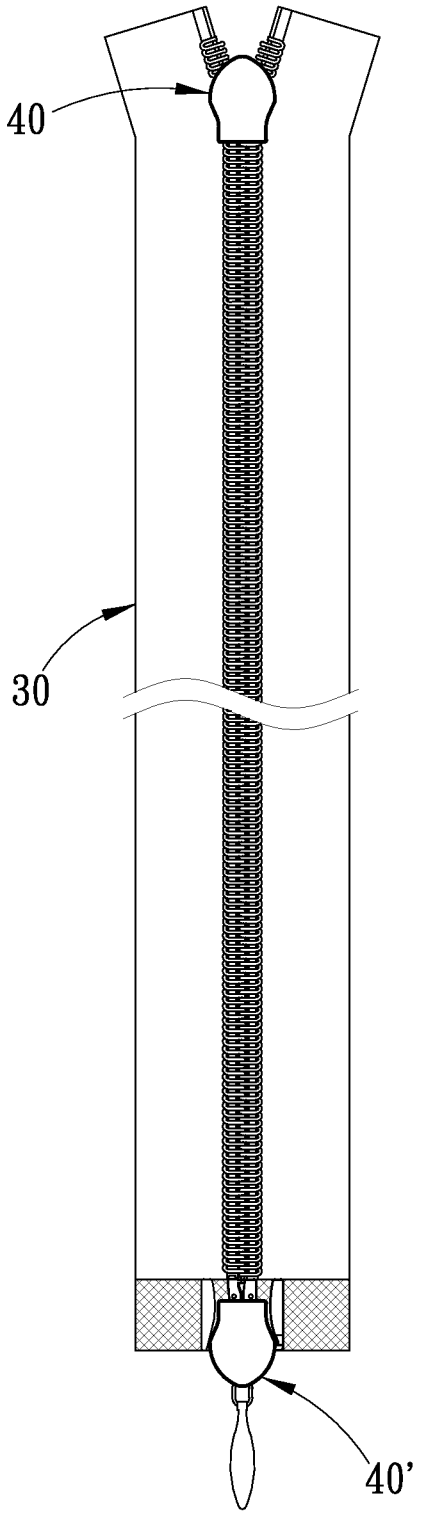
FIG. 17 is a schematic diagram of the back side of the application of the bottom stop device of the present invention to the double-open end invisible zipper.
Figure 18:
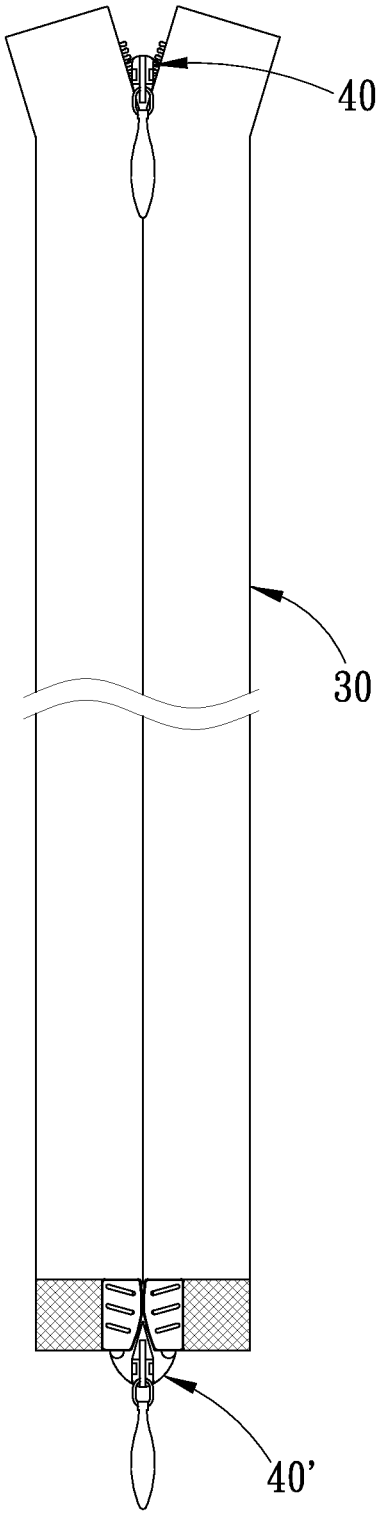
FIG. 18 is a schematic front view of the application of the bottom stop device of the present invention to the double-open end invisible zipper.

The above-mentioned FIG. 1 to FIG. 16 show the embodiment of the bottom stop device of the present invention applied to the double-open end anti-pinch zipper, but the bottom stop device of the present invention can also be installed on a double open tail invisible zipper of which the inner side of the chain fabric has a reflexed chain tooth belt. Referring to FIG. 17 and FIG. 18, the upper and lower zipper sliders 40 and 40' of the double-open end zipper 30 are assembled on the back between the first chain fabric 311 and the second chain fabric 311', so that the upper and lower zipper sliders 40, 40' are on the same side as the series of teeth 32 on the back. The front pull tabs of the upper and lower zipper sliders 40 and 40' pass between the first chain fabric 311 and the second chain fabric 311' through the front of the double-opening invisible zipper. As shown in FIG. 1, it is the front of the double-open end anti-pinch zipper, and the upper and lower zipper sliders 40, 40', pull tabs and series of teeth 32 are on the front of the two chain straps 31, 31', so that the zipper sliders are not visible on the back side shown in FIG. 2, so it has the anti-pinch function. FIG. 17 shows the back of the double-opening invisible zipper, the upper and lower zipper sliders 40, 40' and series of teeth 32 are hidden on the back of the two chain straps 31, 31', and only the pull tabs are on the front of the two chain straps 31, 31' (as shown in FIG. 18). Other structures are the same as the above-mentioned double-open end anti-pinch zipper, so there is no need to repeat the description.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A bottom stop device of a double-open end zipper, which is used to be respectively combined with the lower ends of two chain straps of a double-open end zipper, as the end of the sliding of the zipper slider of the double-open end zipper, said double-open end zipper comprising a stopper pin unit and a movable pin unit, respective inner sides of said stopper pin unit and said movable pin unit being able to be close to each other and fastened together, wherein:

said stopper pin unit is used for injection molding at a lower end of a first chain fabric of one of the said two chain straps of said double-open end zipper, said stopper pin unit comprising a stop pin, a first back plate, a first chain fabric groove, a stopper and a first clamping block integrally formed, said stop pin being a first bar-shaped body formed on an inner side of a front of said first back plate, said stop pin extending from a top side of said first back plate along the said inner side of said first back plate to a top side of said first back plate, said stop pin having upper end thereof used to align with a lower end of a series of teeth on an inner side of said first chain fabric, said first back plate being connected to a back side said stop pin and extending to the outside of said stop pin to form a plate body, said first chain fabric groove being formed between said stop pin and said first back plate, said first chain fabric groove having a first opening towards the upper end of said stop pin and an outer side of said stop pin, said stopper being formed on a front side of a bottom edge of said first back plate and protruding forward from a front side of said first back plate, said stop pin having a lower end thereof connected to an inner end of said stopper, said first clamping block being formed on an outer side of the front of said first back plate to form a first clamping gap with said first back plate;

said movable pin unit is used for injection molding at a lower end of a second chain fabric of the other of the said two chain straps of said double-open end zipper, said movable pin unit comprising a movable pin, a second back plate, a second chain fabric groove and a second clamping block integrally formed, said movable pin being a second bar-shaped body formed on an inner side of a front of said second back plate, said movable pin extending from a top edge of said second back plate along an inner edge of said second back plate to a bottom edge of said second back plate and protruding from the bottom edge of said second back plate, said movable pin having upper end thereof used to align with a lower end of a series of teeth on an inner side of said second chain fabric, said second back plate being connected to a back side of said movable pin and extending to an outer side of said movable pin to form a plate body, said second chain fabric groove being formed between said movable pin and said second back plate, said second chain fabric groove, said second chain fabric groove having a second opening towards the upper end of said movable pin and an outer edge of said movable pin, said second clamping block being formed on a front outer side of said second back plate, said second clamping block forming a second clamping gap with said second back plate.

2. The bottom stop device of a double-open end zipper as claimed in claim 1, wherein said first bar-shaped body of said stop pin has a first upper section and a first lower section, said first upper section being parallel to the inner side of said first chain fabric, said first lower section extending obliquely downward towards an outer edge of said first upper section and connected to the inner end of said stopper; said second bar-shaped body of said movable pin has a second upper section and a second lower section, said second upper section being parallel to the inner side of said second chain fabric, said second lower section having an outer edge thereof facing said second upper section extending obliquely to the bottom edge of said second back plate.

3. The bottom stop device of a double-open end zipper as claimed in claim 2, wherein said stopper is provided with a through hole, said through hole being connected between opposing top and bottom surfaces of said stopper and being used for allowing the components of the zipper slider to penetrate said through hole.

4. The bottom stop device of a double-open end zipper as claimed in claim 2, wherein said first clamping block has a lower end thereof connected to an outer end of said stopper, said first clamping block defining with said stopper a concave arc surface therebetween.

5. The bottom stop device of a double-open end zipper as claimed in claim 2, wherein said first back plate has a first connecting portion located on a front of an inner side thereof and connected to a back of said stop pin, said first connecting portion being adjacent to said first chain fabric groove; said second back plate has a second connecting portion located on a front of an inner side thereof and connected to a back of said movable pin, said second connecting portion being adjacent to said second chain fabric groove.

6. The bottom stop device of a double-open end zipper as claimed in claim 2, wherein said first back plate is connected with said first clamping block through a first connecting pin; said second back plate is connected with said second clamping block through a second connecting pin.

7. The bottom stop device of a double-open end zipper as claimed in claim 2, wherein said stop pin has a first latch projection protruded from the inner edge thereof; said movable pin has a second latch projection protruded from the inner edge thereof and a snap groove located on said second latch projection; when said movable pin is close to said stopper pin unit, said first latch projection is embedded in said snap groove.

8. An assembly structure of the bottom stop device of the double-open end zipper, comprising a double-open end zipper, a stopper pin unit and a movable pin unit, wherein:

said double-open end zipper comprises a first chain strap, a second chain strap and two zipper sliders, said zipper sliders driving said first chain strap and said second chain strap to be linked or separated from each other, said first chain strap comprising a first chain fabric and a series of teeth combined in said first chain fabric, said second chain strap comprising a second chain fabric and a series of teeth combined in said second chain fabric, said first chain fabric and said second chain fabric each having an inner edge thereof respectively folded toward a front side to form a chain tooth belt so that a sliding space is formed between said first chain fabric and said second chain fabric and the respective said chain tooth belt respectively, each said sliding space having an opening side thereof facing an outer edge of the associating said first chain fabric or said second chain fabric, said two series of teeth being respectively combined on the respective said chain tooth belts, so that said series of teeth are respectively located on a front of said first chain fabric and said second chain fabric and the opposite sides of said first chain fabric and said second chain fabric respectively cover said series of teeth;

said stopper pin unit comprising a stop pin, a first back plate, a first chain fabric groove, a stopper and a first clamping block integrally formed, said stop pin being a first bar-shaped body formed on an inner side of a front of said first back plate, said stop pin extending from a top side of said first back plate along the said inner side of said first back plate to a top side of said first back plate, said stop pin having upper end thereof used to align with a lower end of a series of teeth on an inner side of said first chain fabric, said first back plate being connected to a back side said stop pin and extending to the outside of said stop pin to form a plate body, said first chain fabric groove being formed between said stop pin and said first back plate, said first chain fabric groove having a first opening towards the upper end of said stop pin and an outer side of said stop pin, said stopper being formed on a front side of a bottom edge of said first back plate and protruding forward from a front side of said first back plate, said stop pin having a lower end thereof connected to an inner end of said stopper, said first clamping block being formed on an outer side of the front of said first back plate to form a first clamping gap with said first back plate;

said stopper pin unit is integrally injection-molded at a lower end of said first chain fabric, so that the near lower end and folded inner edge of said first chain fabric are extended and fixed in said first chain fabric groove, said sliding space of said first chain fabric having a lower end thereof aligned with an upper end of said first chain fabric groove, said stop pin having an upper end thereof connected to an end of the chain tooth belt of said first chain fabric, said first chain fabric having a back of a lower end thereof attached to the front of said first back plate and extending laterally through said first clamping gap, so that said first chain fabric protrudes from an outer side of said first back plate, said first back plate has a front thereof closely connected to a back of said first chain fabric, said stopper protruding forward from the front of said first back plate to a lower end of the front of said first chain fabric and being used to block said two zipper sliders, said first clamping block being injection-molded on the front of said first chain fabric, so as to clamp said first chain fabric with said first back plate;

said movable pin unit comprising a movable pin, a second back plate, a second chain fabric groove and a second clamping block integrally formed, said movable pin being a second bar-shaped body formed on an inner side of a front of said second back plate, said movable pin extending from a top edge of said second back plate along an inner edge of said second back plate to a bottom edge of said second back plate and protruding from the bottom edge of said second back plate, said movable pin having upper end thereof used to align with a lower end of a series of teeth on an inner side of said second chain fabric, said second back plate being connected to a back side of said movable pin and extending to an outer side of said movable pin to form a plate body, said second chain fabric groove being formed between said movable pin and said second back plate, said second chain fabric groove, said second chain fabric groove having a second opening towards the upper end of said movable pin and an outer edge of said movable pin, said second clamping block being formed on a front outer side of said second back plate, said second clamping block forming a second clamping gap with said second back plate; and said movable pin unit is integrally injection molded at a lower end of said second chain fabric, so that the near lower end and folded inner edge of said second chain fabric are extended and fixed in said second chain fabric groove, said sliding space of said second chain fabric having a lower end thereof aligned with an upper end of said second chain fabric groove, said movable pin having an upper end thereof jointed joined to an end of the said chain tooth belt of said second chain fabric by injection molding, said second chain fabric having a back of a near lower end thereof attached to a front of said second back plate and extending laterally through said second clamping gap, so that said second chain fabric protrudes from an outer side of said second back plate, said second back plate having a front thereof closely connected to a back of said second chain fabric, said second clamping block being injection-molded and attached to a front of said second chain fabric, so as to clamp said second chain fabric with said second back plate.

9. The assembly structure of the bottom stop device of the double-open end zipper as claimed in claim 8, wherein said first bar-shaped body of said stop pin has a first upper section and a first lower section, said first upper section being parallel to the inner side of said first chain fabric, said first lower section extending obliquely downward towards an outer edge of said first upper section and connected to the inner end of said stopper; said second bar-shaped body of said movable pin has a second upper section and a second lower section, said second upper section being parallel to the inner side of said second chain fabric, said second lower section having an outer edge thereof facing said second upper section extending obliquely to the bottom edge of said second back plate.

10. The assembly structure of the bottom stop device of the double-open end zipper as claimed in claim 9, wherein said stopper is provided with a through hole, said through hole being connected between opposing top and bottom surfaces of said stopper and being used for allowing the components of the zipper slider to penetrate said through hole.

11. The assembly structure of the bottom stop device of the double-open end zipper as claimed in claim 9, wherein said first clamping block has a lower end thereof connected to an outer end of said stopper, said first clamping block defining with said stopper a concave arc surface therebetween.

12. The assembly structure of the bottom stop device of the double-open end zipper as claimed in claim 9, wherein said first back plate has a first connecting portion located on a front of an inner side thereof and connected to a back of said stop pin, said first connecting portion being adjacent to said first chain fabric groove; said second back plate has a second connecting portion located on a front of an inner side thereof and connected to a back of said movable pin, said second connecting portion being adjacent to said second chain fabric groove.

13. The assembly structure of the bottom stop device of the double-open end zipper as claimed in claim 9, wherein said first back plate is connected with said first clamping block through a first connecting pin, said first connecting pin passing through said first chain fabric.

14. The assembly structure of the bottom stop device of the double-open end zipper as claimed in claim 9, wherein said second back plate is connected with said second clamping block through a second connecting pin, said second connecting pin passing through said second chain fabric.

15. The assembly structure of the bottom stop device of the double-open end zipper as claimed in claim 9, wherein said stop pin has a first latch projection protruded from the inner edge thereof; said movable pin has a second latch projection protruded from the inner edge thereof and a snap groove located on said second latch projection; when said movable pin is close to said stopper pin unit, said first latch projection is embedded in said snap groove.

* * * * *